US005894820A

United States Patent [19]

Baeta

[11] Patent Number: 5,894,820

[45] Date of Patent: Apr. 20, 1999

[54] ENGINE FOR CONVERTING LINEAR MOTION INTO ROTATIONAL MOTION

[76] Inventor: Manuel C. Baeta, 296 Mohawk Rd. West, Hamilton, Ontario, Canada, L9C 1W3

[21] Appl. No.: 09/054,242

[22] Filed: Apr. 2, 1998

[51] Int. Cl.[6] ..... F02B 75/18

[52] U.S. Cl. ..... 123/56.1; 123/61 R

[58] Field of Search ..... 123/197.1, 56.1, 123/56.2, 61 V, 61 R

[56] References Cited

U.S. PATENT DOCUMENTS

| | | | |
|---|---|---|---|
| 829,279 | 8/1906 | Mears | 123/197.1 |
| 931,531 | 8/1909 | Wade | 123/61 V |
| 1,076,179 | 10/1913 | Whitehead | 123/56.1 |
| 1,580,608 | 9/1926 | Jones | 123/61 V |
| 2,569,269 | 9/1951 | Wilkins | 123/61 V |

FOREIGN PATENT DOCUMENTS

| | | | |
|---|---|---|---|
| 424867 | 2/1926 | Germany | 123/56.2 |

*Primary Examiner*—Noah P. Kamen

[57] ABSTRACT

An engine is provided including a housing with at least one air and fuel injection assembly for injecting air and fuel within the housing. Also included is a translation assembly with a piston adapted to reciprocate along a first axis upon the ignition of the fuel. A rotation assembly remains in communication with the translation and is adapted to rotate about a second axis which is parallel with the first axis.

13 Claims, 4 Drawing Sheets

ENGINE FOR CONVERTING LINEAR MOTION INTO ROTATIONAL MOTION

BACKGROUND OF THE INVENTION

1. Field of the Invention

The present invention relates to combustion engines and more particularly pertains to a new engine for converting linear motion into rotational motion without the use of a crank shaft or the like.

2. Description of the Prior Art

The use of combustion engines is known in the prior art. More specifically, combustion engines heretofore devised and utilized are known to consist basically of familiar, expected and obvious structural configurations, notwithstanding the myriad of designs encompassed by the crowded prior art which have been developed for the fulfillment of countless objectives and requirements.

Known prior art combustion engines include U.S. Pat. No. 5,189,994; U.S. Pat. No. 4,970,995; U.S. Pat. No. 4,765,287; U.S. Pat. No. 4,993,374; U.S. Pat. No. 4,658,768; and U.S. Pat. Des. 324,221.

In these respects, the engine for converting linear motion into rotational motion according to the present invention substantially departs from the conventional concepts and designs of the prior art, and in so doing provides an apparatus primarily developed for the purpose of converting linear motion to rotational motion in a combustion engine without the use of a crank shaft or the like.

SUMMARY OF THE INVENTION

In view of the foregoing disadvantages inherent in the known types of combustion engines now present in the prior art, the present invention provides a new engine for converting linear motion into rotational motion construction wherein the same can be utilized for converting linear motion to rotational motion in a combustion engine without the use of a crank shaft or the like.

The general purpose of the present invention, which will be described subsequently in greater detail, is to provide a new engine for converting linear motion into rotational motion apparatus and method which has many of the advantages of the combustion engines mentioned heretofore and many novel features that result in a new engine for converting linear motion into rotational motion which is not anticipated, rendered obvious, suggested, or even implied by any of the prior art combustion engines, either alone or in any combination thereof.

To attain this, the present invention generally comprises a hollow housing having a generally cylindrical configuration. As shown in FIG. 1, a pair of fuel and air input assemblies each include a disk-shaped plate mounted to either a first end of the housing or a central extent of the housing. As such, a first chamber and a second chamber are defined. The plate of each fuel and air input assembly includes a central bore formed therein. Connected between a periphery of the central bore and an outer edge of the plate is an air input conduit. Also included is a fuel input conduit formed in each plate between an inner face of the plate and the outer edge thereof. As shown in FIGS. 1 & 7, an exhaust mechanism includes a plurality of radially extending exhaust apertures formed in a common plane which bisects the housing at a central extent thereof. An annular manifold container is mounted about an outer surface of the container for encompassing the radially extending exhaust apertures. For releasing pressure from within the housing, an outlet is formed in an outer edge of the container. For generating linear motion, a translation assembly is provided including a piston with a generally disk-shaped configuration. The piston also has an outer surface with an annular recess formed therein which defines a pair of annular contact surfaces. Each of such contact surfaces has a sliding ring mounted thereon for sliding along an inner surface of the housing between the plates of the fuel and air input assemblies. As shown in FIG. 1, a length of the piston is slightly less than ½ that of the housing. The translation assembly further includes a cylindrical shaft fixedly coupled in coaxial relationship with the piston. The shaft extends from both sides thereof thus defining two shaft portions. Each shaft portion has elongated slots formed therein along a length thereof. By this structure, the piston and shaft portions are adapted to reciprocate within the first chamber upon the injection and ignition of air and fuel within the respective air and fuel input assemblies. The translation assembly further includes an extension coupled to one of the shaft portions. This extension is slidably situated through the bore of the plate of one of the fuel and air input assemblies. The extension has a bottom block including a first pair of opposite sides with ball bearings. Note FIG. 5. The ball bearings are adapted for slidably engaging the inner surface of the second chamber of the housing, as shown in FIG. 4. A pair of arcuate recesses are formed in a second pair of opposite sides of the bottom block. Formed between the second pair of opposite sides is a diametrically disposed bore. For reasons that will become apparent hereinafter, a sliding rod is slidably situated within the diametrically opposed bore. For converting the linear motion to rotating motion, a rotation assembly is provided including a pair of ball screws rotatably mounted within the second chamber of the housing. As shown in FIG. 1, the ball screws are situated in parallel relationship with the shaft of the translation assembly. Further, the ball screws reside within the arcuate recesses formed in the bottom block of the translation assembly. In use, a first one of the ball screws is rotated upon the translation of the shaft in a first direction. Also, a second one of the ball screws is rotated upon the translation of the shaft in a second direction. For exploiting the motion of the first shaft, an output gear is connected thereto. Note FIG. 1.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new engine for converting linear motion into rotational motion apparatus and method which has many of the advantages of the combustion engines mentioned heretofore and many novel features that result in a new engine for converting linear motion into rotational motion which is not anticipated, rendered obvious, suggested, or even implied by any of the prior art combustion engines, either alone or in any combination thereof.

It is another object of the present invention to provide a new engine for converting linear motion into rotational motion which may be easily and efficiently manufactured and marketed.

It is a further object of the present invention to provide a new engine for converting linear motion into rotational motion which is of a durable and reliable construction.

An even further object of the present invention is to provide a new engine for converting linear motion into rotational motion which is susceptible of a low cost of manufacture with regard to both materials and labor, and which accordingly is then susceptible of low prices of sale to the consuming public, thereby making such engine for converting linear motion into rotational motion economically available to the buying public.

Still yet another object of the present invention is to provide a new engine for converting linear motion into rotational motion which provides in the apparatuses and methods of the prior art some of the advantages thereof, while simultaneously overcoming some of the disadvantages normally associated therewith.

Still another object of the present invention is to provide a new engine for converting linear motion into rotational motion without the use of a crank shaft or the like.

Even still another object of the present invention is to provide a new engine for converting linear motion into rotational motion that includes a housing with at least one air and fuel injection assembly for injecting air and fuel within the housing. Also included is a translation assembly with a piston adapted to reciprocate along a first axis upon the ignition of the fuel. A rotation assembly remains in communication with the translation and is adapted to rotate about a second axis which is parallel with the first axis.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
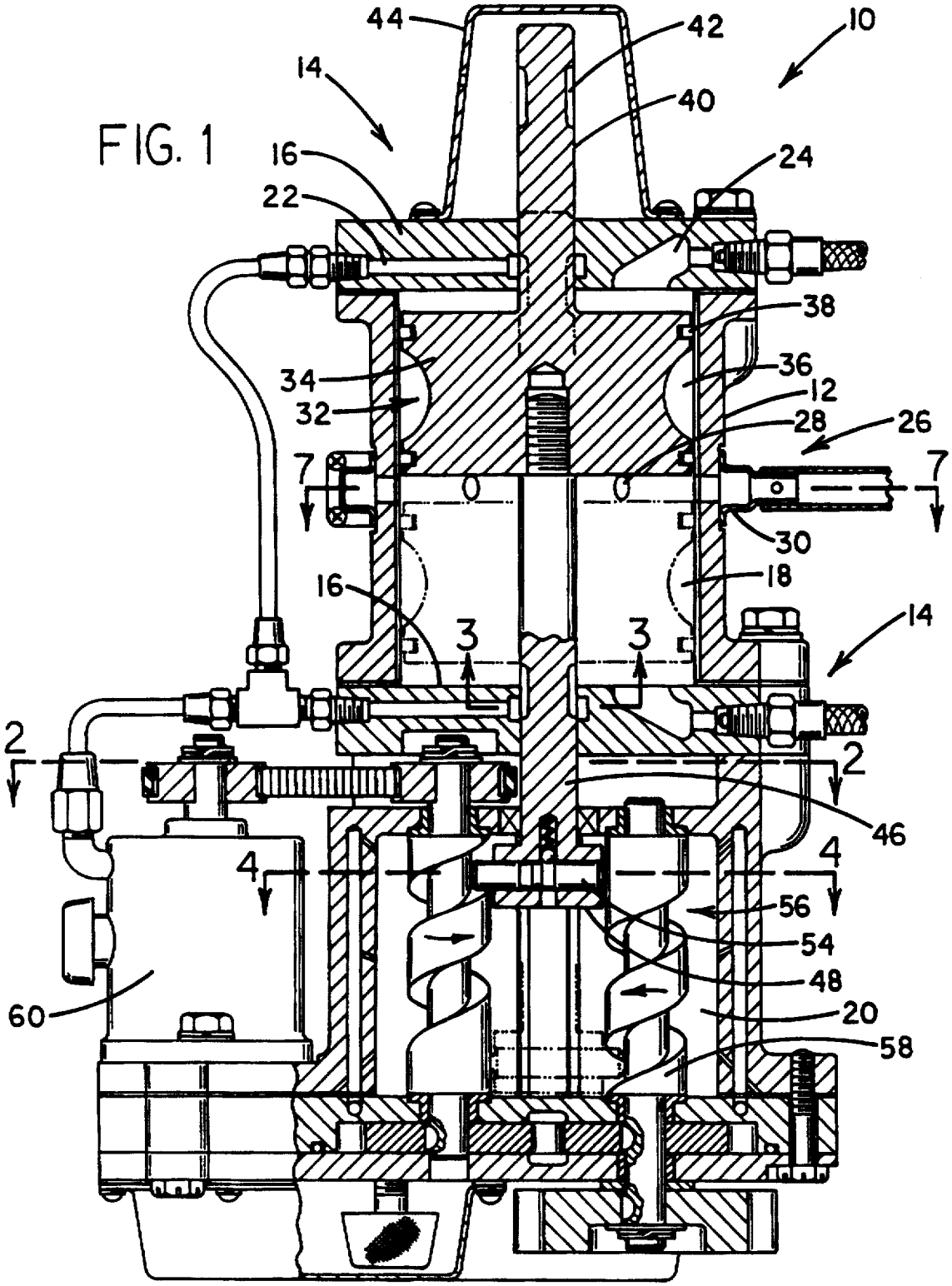
FIG. 1 is a cross-sectional view of a new engine for converting linear motion into rotational motion according to the present invention.

With reference now to the drawings, and in particular to FIGS. 1 through 8 thereof, a new engine for converting linear motion into rotational motion embodying the principles and concepts of the present invention and generally designated by the reference numeral 10 will be described.

The present invention, designated as numeral 10, includes a hollow housing 12 having a generally cylindrical configuration. As shown in FIG. 1, a pair of fuel and air input assemblies 14 each include a disk-shaped plate 16 mounted to either a first end of the housing or a central extent of the housing. As such, a first chamber 18 and a second chamber 20 are defined. The plate of each fuel and air input assembly includes a central bore formed therein. Connected between a periphery of the central bore and an outer edge of the plate is an air input conduit 22. Also included is a fuel input conduit 24 formed in each plate between an inner face of the plate and the outer edge thereof.

Figure 7:
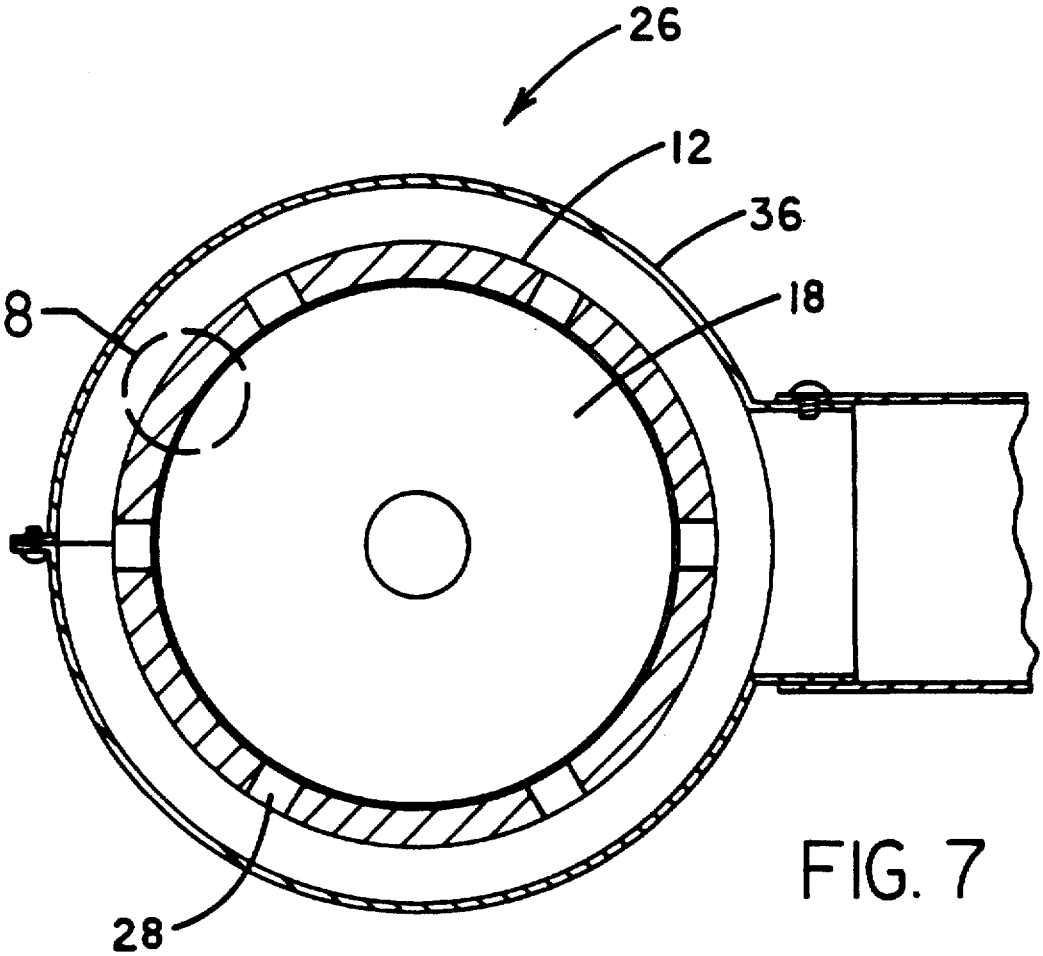
FIG. 7 a cross-sectional view taken along line 7—7 shown in FIG. 1 which depicts the exhaust unit of the present invention.
Figure 8:
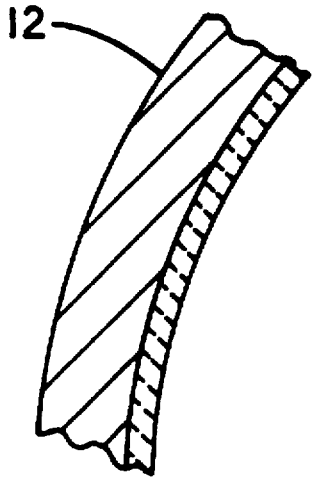
FIG. 8 is a cross-sectional view of the first chamber of the housing of the present invention with its ceramic lining.

As shown in FIGS. 1 & 7, an exhaust mechanism 26 includes a plurality of radially extending exhaust apertures 28 formed in a common plane which bisects the first chamber of the housing at a central extent thereof. An annular manifold container 30 is mounted about an outer surface of the container for encompassing the radially extending exhaust apertures. For releasing pressure from within the first chamber of the housing, an outlet is formed in an outer edge of the container.

For generating linear motion, a translation assembly 32 is provided including a piston 34 with a generally disk-shaped configuration. The piston also has an outer surface with an annular recess 36 formed therein which defines a pair of annular contact surfaces. Each of such contact surfaces has a sliding ring 38 mounted thereon for sliding along an inner surface of the first chamber of the housing between the plates of the fuel and air input assemblies. For further affording a sliding relationship with minimal friction, the inner surface of the first chamber of the housing is lined with ceramic which is capable of withstanding high temperatures. Note FIG. 8. As shown in FIG. 1, a length of the piston is slightly less than ½ that of the housing.

The translation assembly further includes a cylindrical shaft 40 fixedly coupled in coaxial relationship with the piston. The shaft extends from both sides of the piston thus defining two shaft portions. Each shaft portion has elongated slots 42 formed therein along a length thereof. By this structure, the piston and shaft portions are adapted to reciprocate within the first chamber upon the injection and ignition of air and fuel within the respective air and fuel input assemblies. This is accomplished by the firing of an unillustrated spark plug on either side of the housing in an alternating fashion. It should be noted that one of the shaft portions exits the first end of the housing when the translation assembly is reciprocating. A vent cover 44 is preferably employed to house such shaft portion, as shown in FIG. 1.

Figure 4:
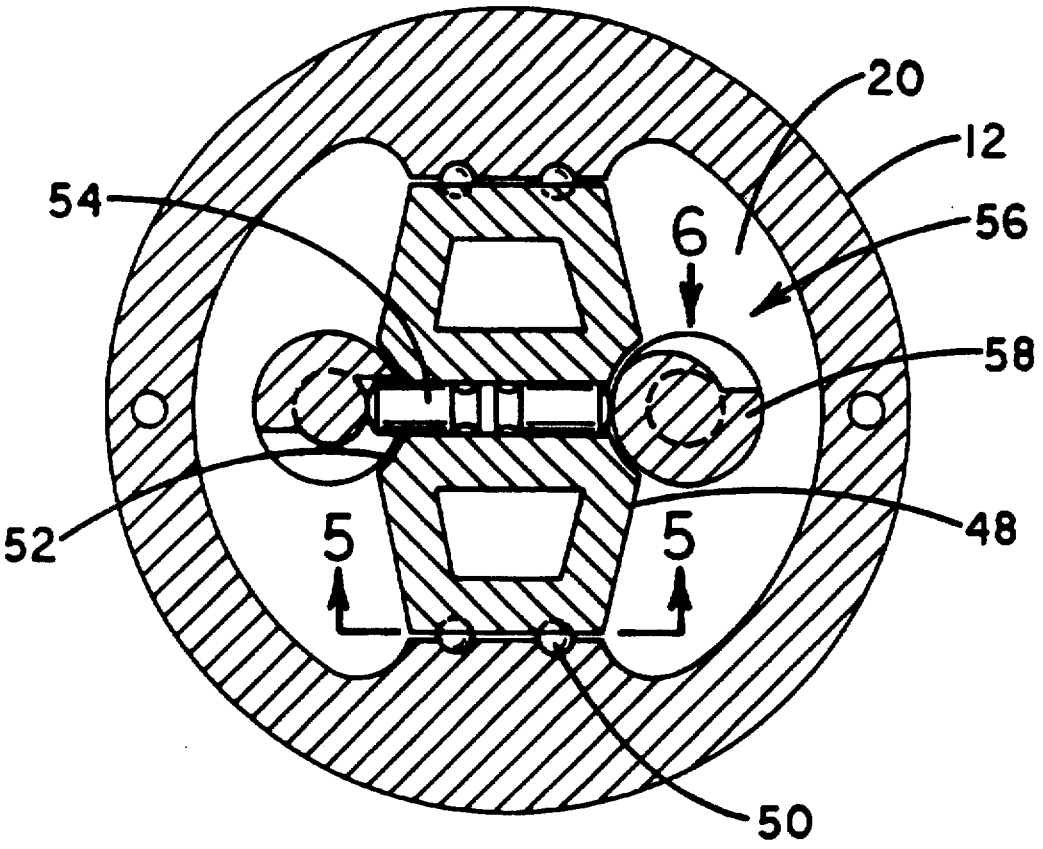
FIG. 4 is a cross-sectional view of the present invention taken along line 4—4 shown in FIG. 1 which depicts the rotation assembly of the present invention.
Figure 5:
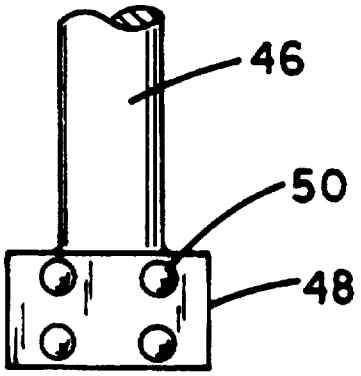
FIG. 5 is a cross-sectional view of the present invention taken along line 5—5 shown in FIG. 4 which depicts the bottom block of the translation assembly of the present invention.
Figure 6:
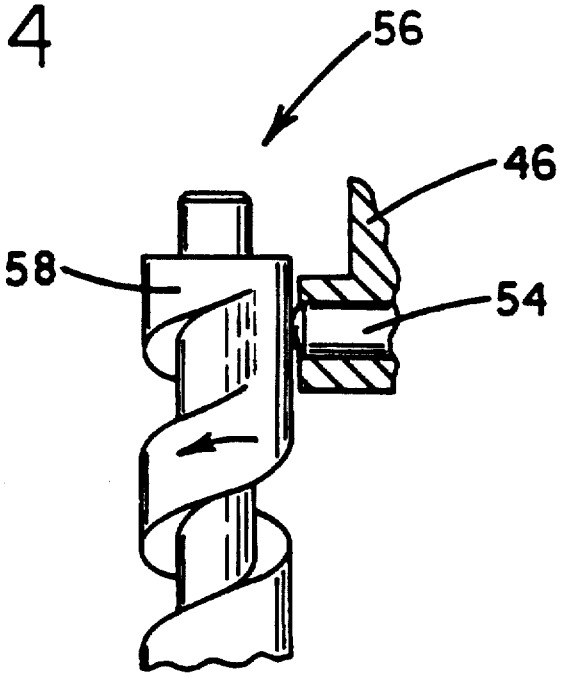
FIG. 6 is a side view of one of the ball screws of the rotation assembly of the present invention.

The translation assembly further includes an extension 46 coupled to one of the shaft portions. This extension is slidably situated through the bore of the plate of one of the fuel and air input assemblies. The extension has a bottom block 48 including a first pair of opposite sides with ball bearings 50. Note FIG. 5. The ball bearings are adapted for slidably engaging the inner surface of the second chamber of the housing, as shown in FIG. 4. A pair of arcuate recesses 52 are formed in a second pair of opposite sides of the bottom block. Formed between the second pair of opposite sides is a diametrically disposed bore. For reasons that will become apparent hereinafter, a sliding rod 54 is slidably situated within the diametrically opposed bore. A spring biased detent is preferably employed in combination with a pair of annular grooves of the sliding rod to allow the rod to slid between two discrete orientations for reasons that will soon become apparent.

For converting the linear motion to rotating motion, a rotation assembly 56 is provided including a pair of ball screws 58 rotatably mounted within the second chamber of the housing. As shown in FIG. 1, the ball screws are situated in parallel relationship with the shaft of the translation assembly. Further, the ball screws reside within the arcuate recesses formed in the bottom block of the translation assembly.

In use, a first one of the ball screws is rotated upon the translation of the shaft in a first direction. Also, a second one of the ball screws is rotated upon the translation of the shaft in a second direction. For exploiting the motion of the first shaft, an output gear is connected thereto. Note FIG. 1. The alternating rotation of the ball screws is accomplished by the sliding rod being transferred between its two discrete orientations upon each reciprocation, thereby engaging only one of the ball screws during each cycle. Preferably, the second chamber is filled with oil by way of an oil pump and screen for reducing friction.

Mounted on the housing and connected to the air input conduit is an air pump 60. The air pump is adapted for injecting air within the first chamber of the housing upon the rotation thereof. To afford operation, the air pump is further coupled to the second ball screw by way of a belt for effecting the rotation thereof. The connection of the air pump with the second ball screw is preferably effected through a recess in the housing so as to access a top end of the second ball screw.

Figure 2:
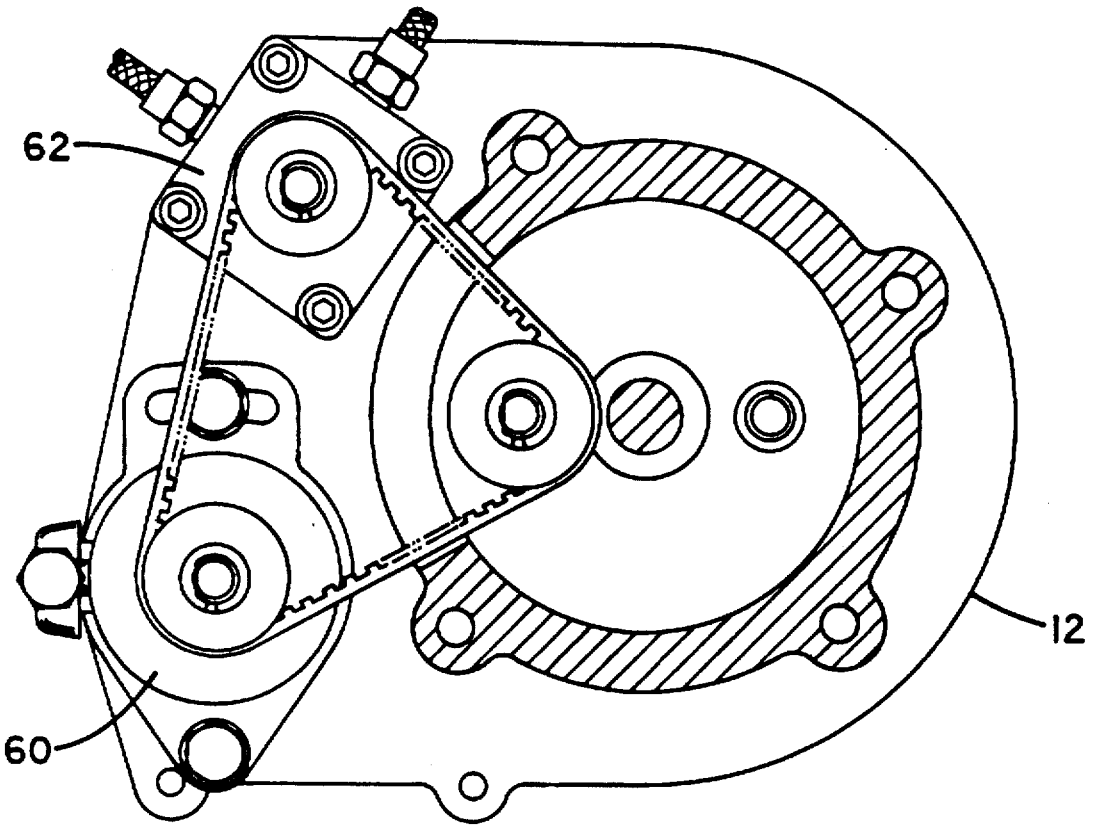
FIG. 2 is a cross-sectional view taken along line 2—2 shown in FIG. 1 which depicts the air and fuel pumps of the present invention.
Figure 3:
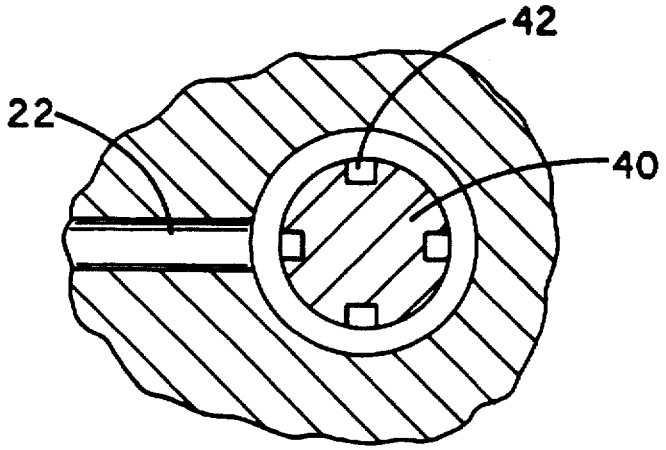
FIG. 3 is a cross-sectional view taken along line 3—3 shown in FIG. 1 which depicts the shaft of the translation assembly of the present invention.

Associated therewith is a fuel pump 62 mounted on the housing and connected to the fuel input conduit. The fuel pump is included for injecting fuel within the first chamber of the housing upon the rotation thereof. As shown in FIG. 2, the fuel pump is coupled to the second ball screw by way of the belt for effecting the rotation thereof.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An engine comprising, in combination:

a hollow housing having a generally cylindrical configuration;

a pair of fuel and air input assemblies including a pair of disk-shaped plates mounted to a first end of the housing and to a central extent of the housing for defining a first chamber and a second chamber, each fuel and air input assembly including a central bore formed therein, an air input conduit connected between a periphery of the central bore and an outer edge of the plate, and a fuel input conduit formed therein between an inner face of the plate and the outer edge of the plate;

an exhaust mechanism including a plurality of radially extending exhaust apertures formed in a common plane which bisects the housing at a central extent thereof, an annular manifold container mounted about an outer surface of the container and encompassing the radially extending exhaust apertures, and an outlet formed in an outer edge of the container for releasing pressure within the housing;

a translation assembly including a piston with a generally disk-shaped configuration, the piston having an outer surface with an annular recess formed therein to define a pair of annular contact surfaces each with a sliding ring mounted thereon for sliding along an inner surface of the housing between the plates of the fuel and air input assemblies, wherein a length of the piston is slightly less than ½ that of the housing, the translation assembly further including a cylindrical shaft fixedly coupled in coaxial relationship with the piston and extending from both sides thereof thus defining two shaft portions, each shaft portion having elongated slots formed therein along a length thereof, whereby the piston and shaft portions are adapted to reciprocate within the first chamber upon the injection and ignition of air and fuel within the respective air and fuel input assemblies;

said translation assembly further including an extension coupled to one of the shaft portions and extended through the bore of the plate of one of the fuel and air input assemblies, the extension having a bottom block including a first pair of opposite sides with ball bearings for slidably engaging the inner surface of the second chamber of the housing, a pair of arcuate recesses formed in a second pair of opposite sides of the bottom block, a diametrically disposed bore formed between the second pair of opposite sides, and a sliding rod slidably situated within the diametrically opposed bore;

a rotation assembly including a pair of ball screws rotatably mounted within the second chamber of the housing in parallel relationship with the shaft of the translation assembly such that the ball screws reside within the arcuate recesses formed in the bottom block of the translation assembly, wherein a first one of the ball screws is rotated upon the translation of the shaft in a first direction and a second one of the ball screws is rotated upon the translation of the shaft in a second direction, the first shaft assembly mounted to an output gear;

an air pump mounted on the housing and connected to the air input conduit for injecting air within the first chamber of the housing upon the rotation thereof, the air pump further being coupled to the second ball screw by way of a belt for effecting the rotation thereof; and a fuel pump mounted on the housing and connected to the fuel input conduit for injecting fuel within the first chamber of the housing upon the rotation thereof, the fuel pump further being coupled to the second ball screw by way of the belt for effecting the rotation thereof.

2. An engine comprising:

a housing;

at least one air and fuel injection assembly for injecting air and fuel within the housing;

a translation assembly including a piston adapted to reciprocate along a first axis upon the ignition of the fuel; and a rotation assembly in communication with the translation assembly and adapted to rotate about a second axis which is at least one of in coaxial alignment with the first axis and parallel with the first axis;

wherein the rotation assembly further includes a pair of ball screws;

wherein the translation assembly further includes an extension with a bore formed therein perpendicular with the first axis and a sliding rod slidably situated within the bore for sliding therein in alternating engagement with the ball screws such that one of the ball screws is adapted to rotate upon movement of the piston in a first direction and another one of the ball screws is adapted to rotate upon the movement of the piston in a second direction.

3. An engine as set forth in claim 2 wherein at least one of the ball screws operates an air pump which supplies air to the air and fuel injection assembly.

4. An engine as set forth in claim 2 wherein at least one of the ball screws operates a fuel pump which supplies fuel to the air and fuel injection assembly.

5. An engine as set forth in claim 2 wherein the housing includes two air and fuel injection assemblies located on opposite sides of the piston.

6. An engine as set forth in claim 5 wherein an exhaust unit is situated between the air and fuel injection assemblies.

7. An engine as set forth in claim 2 wherein at least one of air and fuel is injected into the housing through a shaft of the translation assembly.

8. An engine comprising:

a housing with a first chamber and a second chamber;

at least one air and fuel injection assembly for injecting air and fuel within the first chamber of the housing;

a translation assembly positioned within the first chamber of the housing and including a piston adapted to reciprocate along a first axis upon the ignition of the fuel; and a rotation assembly in communication with the translation assembly and adapted to rotate about a second axis which is at least one of in coaxial alignment with the first axis and parallel with the first axis;

wherein the rotation assembly includes a pair of ball screws positioned within the second chamber of the housing;

wherein the translation assembly further includes an extension in engagement with the ball screws such that one of the ball screws is adapted to rotate upon movement of the piston in a first direction and another one of the ball screws is adapted to rotate upon the movement of the piston in a second direction;

wherein the extension has a plurality of ball bearings mounted thereon for slidably engaging opposed walls of the second chamber.

9. An engine as set forth in claim 8 wherein at least one of the ball screws operates an air pump which supplies air to the air and fuel injection assembly.

10. An engine as set forth in claim 8 wherein at least one of the ball screws operates a fuel pump which supplies fuel to the air and fuel injection assembly.

11. An engine as set forth in claim 8 wherein the housing includes two air and fuel injection assemblies located on opposite sides of the piston.

12. An engine as set forth in claim 11 wherein an exhaust unit is situated between the air and fuel injection assemblies.

13. An engine as set forth in claim 8 wherein at least one of air and fuel is injected into the housing through a shaft of the translation assembly.

* * * * *